US005797366A

United States Patent [19]

Adamovski

[11] Patent Number: 5,797,366

[45] Date of Patent: Aug. 25, 1998

[54] TOROIDAL INTERNAL COMBUSTION ENGINE

[75] Inventor: Victor Isaevich Adamovski, Petah Tikvah, Israel

[73] Assignee: New Devices Engineering A.K.O. Ltd., Petah Tikvah, Israel

[21] Appl. No.: 743,434

[22] Filed: Nov. 1, 1996

[51] Int. Cl.[6] ..... F02B 53/00

[52] U.S. Cl. ..... 123/237; 123/215; 123/240; 418/94; 418/99; 418/141; 418/178

[58] Field of Search ..... 123/213, 215, 123/237, 248; 418/91, 94, 99, 141, 245, 247

[56] References Cited

U.S. PATENT DOCUMENTS

| | | | |
|---|---|---|---|
| 568,337 | 9/1896 | Deschamps | 418/141 |
| 1,319,456 | 10/1919 | Bingham | 418/141 |
| 1,916,318 | 7/1933 | Huber | 123/237 |
| 2,447,929 | 8/1948 | Berry | 123/215 |
| 3,644,069 | 2/1972 | Stewart | 418/141 |

FOREIGN PATENT DOCUMENTS

| | | | |
|---|---|---|---|
| 581688 | 8/1933 | Germany | 418/94 |
| 1149941 | 6/1963 | Germany | 123/215 |

*Primary Examiner*—Michael Koczo
*Attorney, Agent, or Firm*—Cohen, Pontani, Lieberman, Pavane

[57] ABSTRACT

An internal combustion engine comprises a toroidal combustion chamber housing within which slides at least one piston. The combustion chamber housing has a circumferential longitudinal slot sealed by a ring seal to which the pistons are rigidly attached. A mechanism is provided for reversibly creating one or more transverse seals within the combustion chamber housing. The space between the transverse seals constitutes one or more combustion chambers. The simplest embodiment of the engine has one combustion chamber and one piston. The combustion chamber is operationally divided by the piston into two regions. The space between the transverse seal and a trailing surface of the piston defines a combustion region. The space between the transverse seal and a leading surface of the piston defines an exhaust region. In each power cycle of the engine, compressed air, fuel and steam are injected into the combustion region and ignited. The resulting hot combustion gases drive the piston around the circular path defined by the toroidal housing, with power being transferred from the piston and the ring seal via a suitable linkage to a central power shaft. Meanwhile, the leading surface of the piston pushes the combustion gases of the previous cycle out of the combustion chamber housing, preferably into a similar toroidal expansion chamber housing where further expansion of the combustion gases drives a second piston that is similarly linked to the power shaft. The scope of the invention also includes a protocol for injecting air, fuel and steam into the combustion housing.

35 Claims, 11 Drawing Sheets

TOROIDAL INTERNAL COMBUSTION ENGINE

FIELD AND BACKGROUND OF THE INVENTION

The present invention relates to internal combustion engines and, more particularly, to an internal combustion engine that is significantly more efficient than those known heretofore.

Internal combustion piston engines have been familiar and ubiquitous since the days of Otto and Diesel. These engines suffer from several widely recognized deficiencies. One is that their thermal efficiencies are far less than their theoretical efficiencies according to the second law of thermodynamics. Up to 30% of the heat released by fuel combustion is absorbed by the engine cooling systems. Another 30% is devoted to engine operation, including compressing air or an air-fuel mixture in the cylinders of these engines. From 5% to 20% of the available energy may be wasted because of incomplete combustion of hydrocarbon fuels. The net result is that these engines generally have overall efficiencies between 32% and 42%.

Another deficiency of these engines is that their exhausts tend to contain toxic substances: carbon particles and carcinogenic hydrocarbons because of incomplete combustion, and nitrogen oxides formed at the high (1800° C. to 2000° C.) combustion temperatures that characterize these engines. A third is that they provide power by transforming the reciprocating motion of their pistons to the rotary motion of their crankshafts. When the fuel-air mixture in a cylinder of an internal combustion engine explodes, the piston is at or near top dead center. At this position, the moment arm, across which the rod connecting the piston to the crankshaft transfers force to the crankshaft, is close to zero. Therefore, the piston exerts minimal torque on the crankshaft. As the piston moves down from top dead center, the moment arm through which the piston transfers force increases, but in the meantime the combustion gases expand somewhat, losing some of their propulsive force, so that the maximum torque exerted on the crankshaft is less than the maximum torque that could be exerted if the force of the piston could always be transferred to the crankshaft at maximum moment arm. Several attempts have been made to address some of these deficiencies. Ferrenberg et al. (U.S. Pat. No. 4,928,658) use a heat exchanger to preheat the input fuel and air of an internal combustion engine with some of the heat of the exhaust gases. Loth et al. (U.S. Pat. No. 5,239,959) ignite the fuel-air mixture in a separate combustion chamber before introducing the burning mixture to the cylinder, in order to attain more complete combustion and inhibit the formation of nitrogen oxides. Forster (U.S. Pat. No. 5,002,481) burns a mixture of fuel, air and steam. This mixture burns at a relatively low temperature of about 1400° C., and nitrogen oxides are not formed. Gunnerman (U.S. Pat. No. 5,156,114) burns a mixture of hydrocarbon fuel and water, but requires a hydrogen-forming catalyst to achieve the same power with his mixture as with ordinary gasoline. Each of these prior art patents addresses only one of the defects of reciprocating internal combustion engines. None addresses the problem in its totality.

There is thus a widely recognized need for, and it would be highly advantageous to have, an internal combustion engine that approaches its theoretical thermal efficiency while emitting minimal pollution.

SUMMARY OF THE INVENTION

According to the present invention there is provided an internal combustion engine for driving a power shaft having an axis of rotation, comprising: (a) a substantially toroidal combustion chamber housing having an inner surface and a circumferential, longitudinal combustion housing slot; (b) at least one combustion chamber housing piston, having a peripheral surface, slidably mounted within the combustion chamber housing; and (c) a substantially annular combustion chamber housing ring seal, rigidly attached to the at least one combustion chamber housing piston, slidably mounted within the combustion chamber housing slot so as to substantially fill the combustion chamber housing slot, and operationally connected to the power shaft so as to transmit force from the at least one combustion chamber housing piston to the power shaft.

According to the present invention there is provided a method for applying torque to a power shaft, comprising the steps of: (a) providing an engine including: (i) a substantially toroidal combustion chamber housing enclosing at least one combustion chamber; (b) introducing air into the at least one combustion chamber; and (c) introducing a fluid hydrocarbon fuel into the at least one combustion chamber.

The engine of the present invention achieves the goals of near-theoretical efficiency and negligible pollution by several means. A mixture of fuel, air and steam is burned at a temperature of between about 1000° C. and 1400° C., thereby minimizing the formation of nitrogen oxides and other pollutants, while reducing the heat lost to conduction and radiation through the engine walls, because of the lower thermal gradient and absolute temperature compared to conventional engines. The mixture is burned within one or more combustion chambers in a toroidal combustion chamber housing, driving one or more pistons (one per combustion chamber) on a circular path through the housing. The axis of rotation of the power shaft of the engine is perpendicular to the plane of the combustion chamber housing. The pistons are connected to the power shaft of the engine, and the force of the pistons is always applied to the power shaft at a constant moment arm perpendicular to that axis of rotation, so that maximum torque is imposed on the power shaft. Preferably, the combustion gases are exhausted to one or more expansion chambers within a second toroidal housing, where they continue to expand, pushing against a second set of pistons that also are connected to the power shaft, thereby imposing further torque on the power shaft. Finally, the combustion gases are exhausted into a heat exchanger, where the residual heat of the exhaust gases preheats the incoming fuel and water.

The scope of the present invention also includes a protocol for injecting fuel, air and steam into the combustion chambers. The fuel is a fluid (liquid or gas) hydrocarbon or mixture of hydrocarbons, such as gasoline, diesel fuel, kerosene, an alcohol such as ethanol and methanol, propane, butane, and natural gas. If the flash point of the injected fuel is sufficiently low, it ignites spontaneously. Otherwise, the fuel is ignited by a conventional ignition means such as a spark plug. Compressed air is provided by an air compressor. In the most preferred embodiment of the engine of the present invention, this compressor is based on a toroidal housing similar to the combustion chamber housing, except that power is delivered to the piston therein to compress the air therein, instead of being extracted from hot combustion gases by the piston therein.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of an internal combustion engine which is more efficient and less polluting than presently known reciprocating engines, and of a protocol for operating the engine. The efficiency of the engine approaches its theoretical value, based on the second law of thermodynamics, when fuel, air and steam are injected in accordance with the protocol of the present invention. The engine of the present invention may be used in any application (transportation, remote electrical power generation, etc.) for which reciprocating internal combustion engines presently are used.

The principles and operation of an engine according to the present invention may be better understood with reference to the drawings and the accompanying description.

Figure 1A:
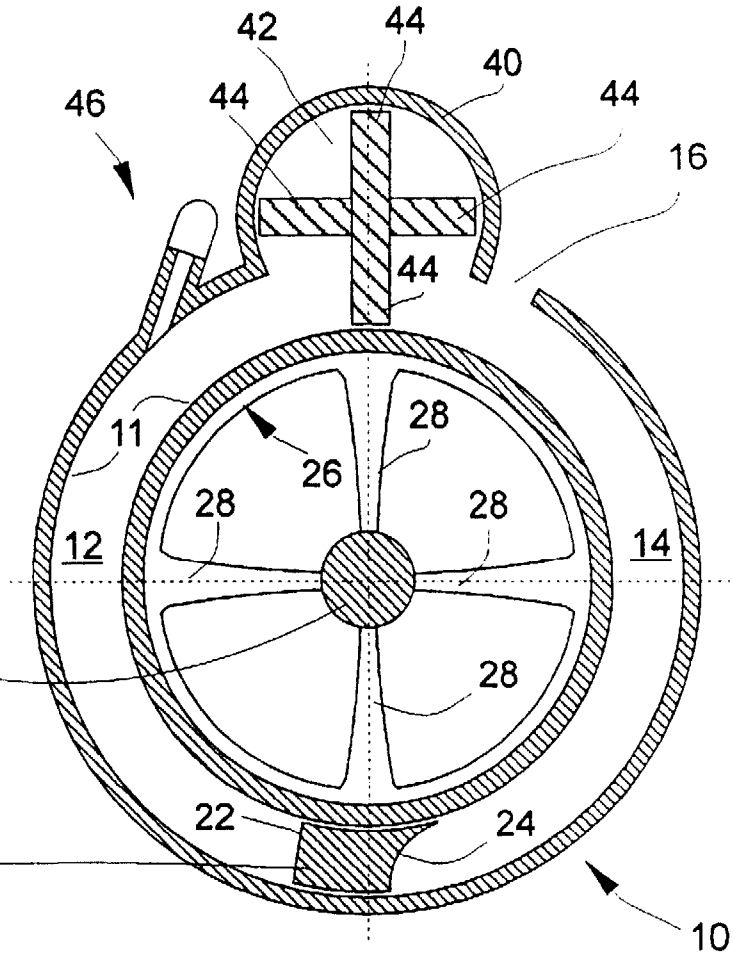
FIG. 1A is a longitudinal cross section through a toroidal combustion chamber housing enclosing one combustion chamber and one piston.
Figure 1B:
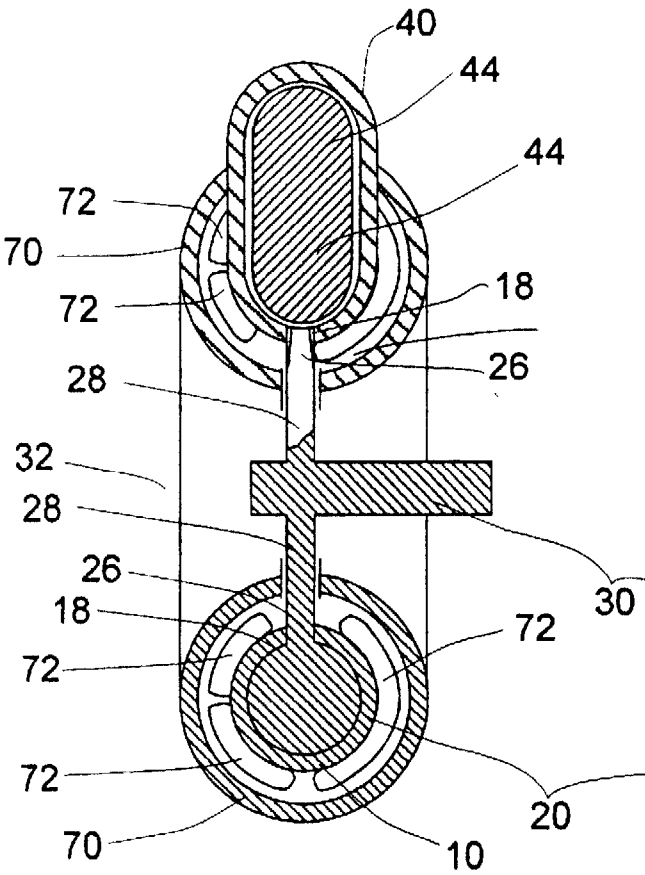
FIG. 1B is a transverse cross section through the toroidal combustion chamber housing of FIG. 1A.

Referring now to the drawings, FIGS. 1A and 1B are transverse and longitudinal sections, respectively, through the heart of the present invention: a toroidal combustion chamber housing 10. Housing 10 has a circular slot 18 that runs all the way around the inner longitudinal circumference of housing 10. Within housing 10 slides a piston 20 that has a trailing surface 22 and a leading surface 24. Piston 20 is rigidly attached to an annular ring seal 26 that fits inside, substantially fills and slides within slot 18. Ring seal 26 is rigidly connected to a power shaft 30 by spokes 28. Power shaft 30 runs through the central hole of toroidal housing 10 and is perpendicular to the plane defined by slot 18 and ring seal 26. Specifically, power shaft 30 is configured to rotate about a longitudinal axis 32 that intersects the center of the central hole of toroidal housing 10. The motion imparted to piston 20 by the combustion of fuel within the combustion chamber (defined below) of toroidal housing 10, as described below, is imparted to power shaft 30 by the rigid connection via ring seal 26 and spokes 28.

The circular cross-section of toroidal housing 10 that is shown in FIG. 1A is illustrative only. As defined herein, a "toroid" or "torus" refers to a figure of revolution generated by the rotation of any plane figure about an axis outside itself. The scope of the present invention includes toroids of any suitable cross-section, including ovoid and rectangular cross-sections.

Attached to toroidal housing 10, and opening thereinto, is a valve housing 40, within which is rotatably mounted a butterfly valve 42 that has four vanes 44. In the position shown in FIGS. 1A and 1B, three of vanes 44 form a seal within toroidal housing 10 and valve housing 40. The interior of toroidal housing 10 beyond valve housing 40 defines a combustion chamber which is further divided into two regions by piston 20 when piston 20 is not adjacent to valve housing 40. Between the left side of valve housing 40 and trailing surface 22 is combustion region 12. Between the right side of valve housing 40 and leading surface 24 is exhaust region 14. Toroidal housing 10 also is provided with an injector 46 and an exhaust port 16.

Figure 1C:
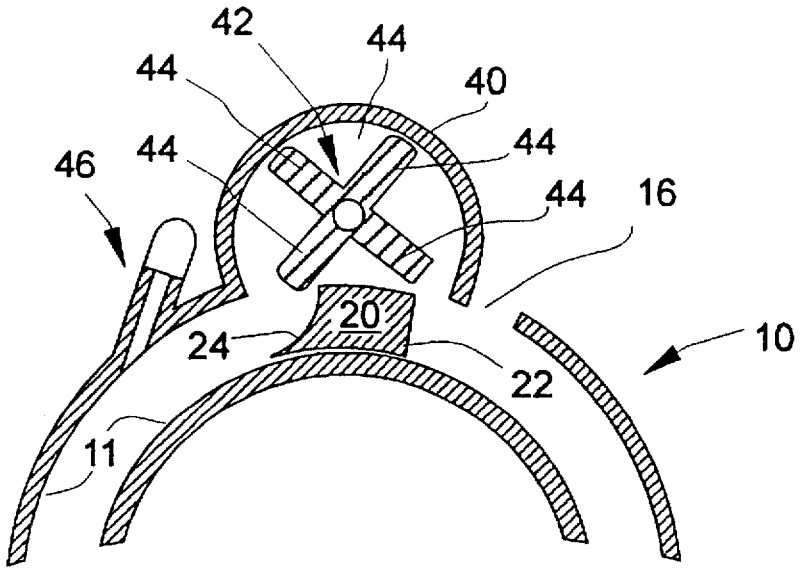
FIG. 1C is a partial longitudinal cross section through the toroidal combustion chamber housing of FIG. 1A, showing the butterfly valve in a position that allows the piston to slide past it.

Piston 20 slides around the circular path defined by toroidal housing 10, as depicted in FIG. 1A, in a counterclockwise direction. Generally, as piston 20 slides around toroidal housing 10, butterfly valve 42 is in the sealing position shown. The exception is when piston 20 slides past valve housing 40. Then, butterfly valve 42 is rotated clockwise to allow piston 20 to pass. FIG. 1C shows the configuration of butterfly valve 42 and piston 20 when piston 20 is halfway across valve housing 40: at that point, butterfly valve 42 has rotated 45°.

The four-vane embodiment of butterfly valve 42 shown in FIGS. 1A, 1B and 1C is illustrative. The scope of the present invention includes two-vane and three-vane configurations as well, and also all equivalent mechanisms for reversibly sealing the combustion chamber of combustion chamber housing 10.

Combustion chamber housing 10 is shown in FIG. 1B surrounded by several tubes 72 and enclosed in a heat exchanger housing 70. The function of heat exchanger housing 70 and tubes 72 will be explained below.

Because of the high temperature at which the engine of the present invention operates, provision must be made for cooling the walls of combustion chamber housing 10 and for cooling piston 20. In addition, special provision must be made for maintaining the integrity of the seal between ring seal 26 and combustion chamber housing 10 at slot 18 against the pressure of combustion gases in combustion region 12, and for lubricating the contacts between ring seal 26 and inner surface 11 of combustion chamber housing 10, and between piston 20 and inner surface 11 of combustion chamber housing 10. All these ends are accomplished, at least in part, by a combined cooling and lubrication system that is illustrated in FIGS. 2A and 2B.

Figure 2A:
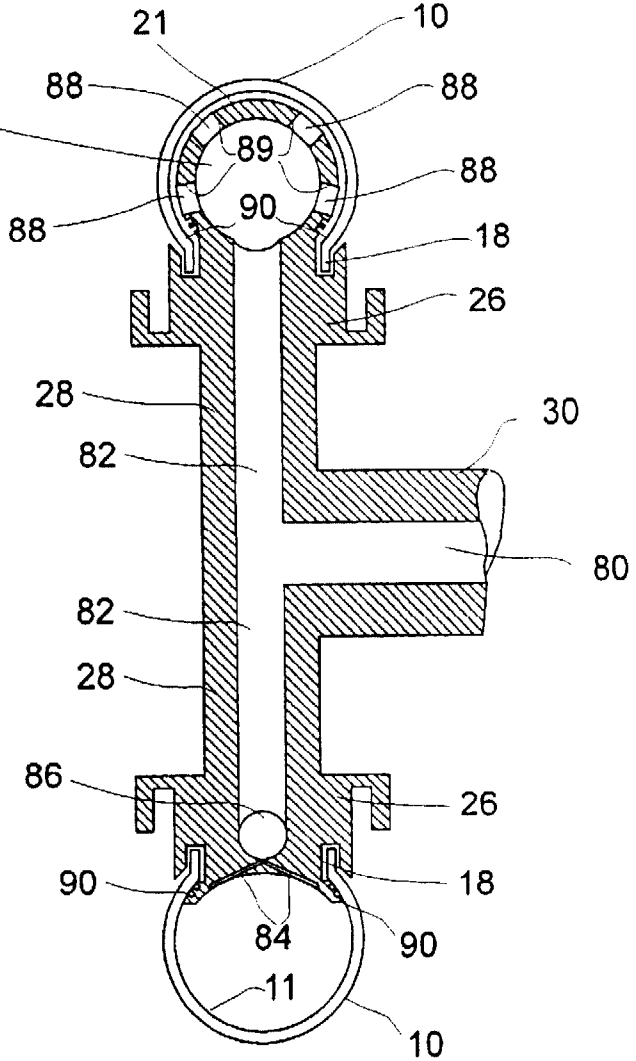
FIG. 2A is a transverse cross section through the ring seal and the piston of FIG. 1A, showing the cooling channels.
Figure 2B:
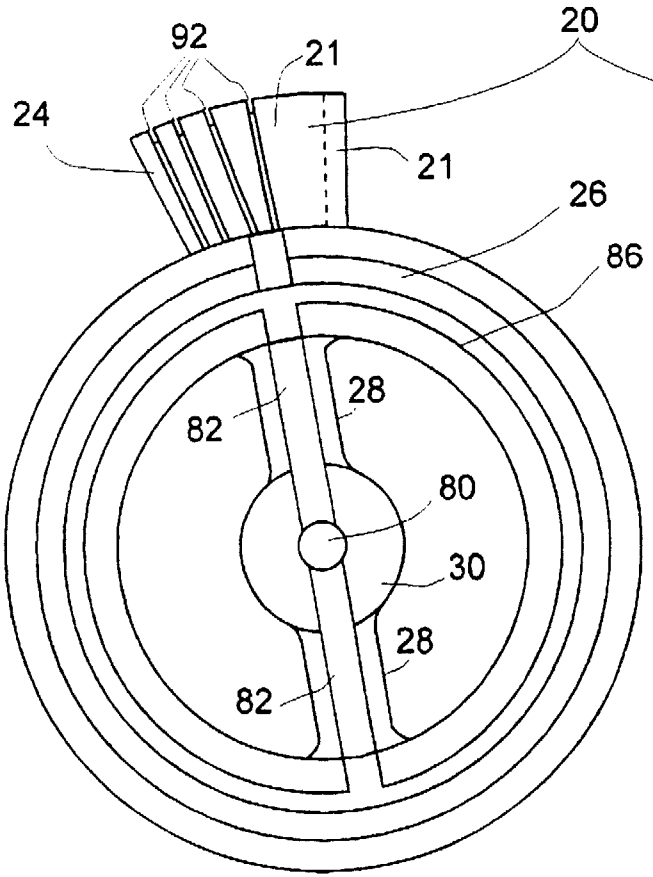
FIG. 2B is a side view of the ring seal and the piston of FIG. 2A.
Figure 2C:
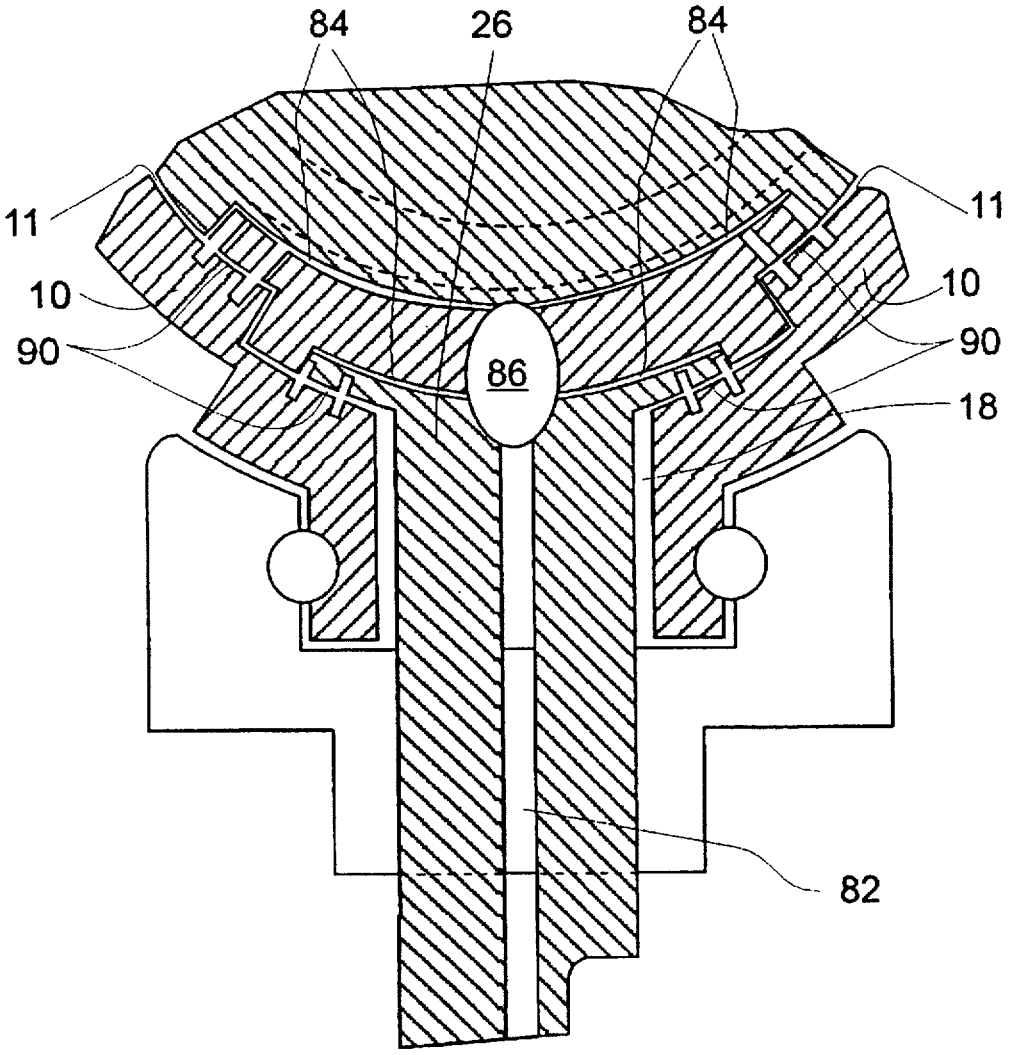
FIG. 2C is a detailed view of the labyrinth seal of FIG. 2A.

FIG. 2A is a transverse cross section through piston 20 and ring seal 26, showing, in addition to the features shown in FIG. 1A, channels for providing cooling water. FIG. 2B is a corresponding composite side view of piston 20 and ring seal 26, showing the exterior of piston 20 and a longitudinal cross section of ring seal 26. A central channel 80 runs longitudinally through the center of power shaft 30. Central channel 80 connects to radial channels 82 that run through spokes 28 to ring seal 26 and to piston 20. A circumferential channel 86 connects to radial channels 82 and runs circumferentially through ring seal 26. Distribution channels 84 lead from circumferential channel 86 to a labyrinth seal 90 where ring seal 26 otherwise would contact inner surface 11 of combustion chamber housing 10. The water introduced to ring seal 26 via channels 80 and 82 serves to cool ring seal 26, and also to lubricate the contact between ring seal 26 and combustion chamber housing 10 along inner surface 11, and to preserve the integrity of the seal between ring seal 26 and combustion chamber housing 10: as water boils at labyrinth seal 90, a sealing and lubricating film of steam is created between labyrinth seal 90 and inner surface 11. FIG. 2C shows labyrinth seal 90 and the associated channels 84, 86 and 82 in more detail. Similarly, distribution channels 88, leading from one of radial channels 82 via the hollow interior of piston 20, provide water to annular grooves 92 around the peripheral surface 21 of piston 20. (For reference in the discussion to follow, the inner surfaces of distribution channels 88 are designated by the reference numeral 89) As water boils in annular grooves 92, a lubricating film of steam is created between peripheral surface 21 and inner surface 11. In operation, water is pumped into central channel 80 at a pressure of between about 120 kg/cm$^2$ and about 400 kg/cm$^2$.

Further protection of combustion chamber housing 10 from the heat of combustion may be accomplished in three other ways. First, the operational protocol of the present invention calls for the injection of steam to combustion region 12 during steady-state operation (defined below). This reduces the combustion temperature within combustion region 12 to between about 1000° C. and about 1400° C., significantly lower than the combustion temperature of between about 1800° C. and about 2000° C. that would be obtained without steam injection. Second, the lines that deliver fuel and superheated water to combustion chamber housing 10 are placed in thermal contact with combustion chamber housing 10, to preheat the fuel and water by conducting some of the heat from combustion chamber housing 10. These lines are represented in FIG. 1B by tubes 72. Third, inner surface 11, trailing surface 22 and butterfly valve 42 may be lined with a thermally insulating, heat resistant material such as a ceramic.

The injection of steam into combustion region 12 also contributes to the increased efficiency of the engine of the present invention, compared to conventional reciprocating engines. Instead of merely carrying off waste heat, in the manner of the cooling liquid of conventional cooling systems, the injected steam expands as it is heated, helping to drive piston 20 within combustion chamber housing 10. Thus, the heat absorbed by the injected steam is converted into mechanical energy instead of merely being dissipated. The net increase in efficiency over conventional engines may be up to about 30%. In addition, the variation in the temperature of combustion chamber housing 10 in the course of one power cycle are much less severe than the corresponding temperature variations of the combustion chambers of conventional reciprocating engines.

Figure 3:
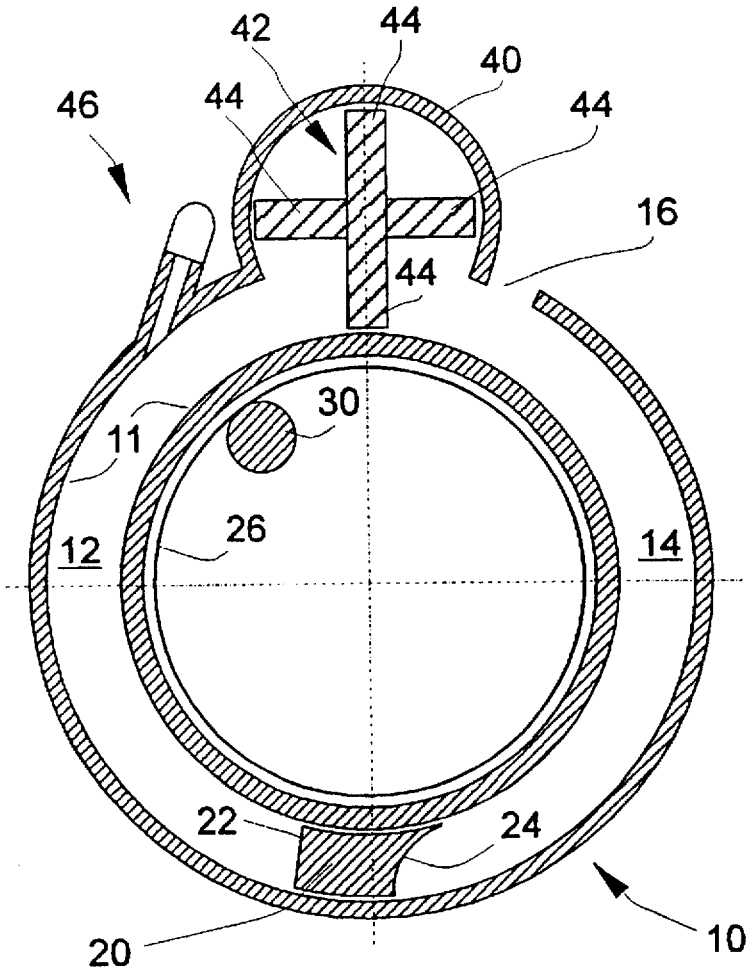
FIG. 3 is a longitudinal cross section through an embodiment of a single-chamber toroidal combustion chamber housing in which the power shaft is placed eccentrically within the central hole of the housing.

The mechanism by which the motion of piston 20 is imparted to power shaft 30 need not be the rigid connection shown in FIG. 1A. FIG. 3 is a partial illustration of an alternative embodiment in which power shaft 30 is mounted eccentrically within the central hole of combustion chamber housing 10, and in direct contact with ring seal 26. Ring seal 26 is coupled mechanically to power shaft 30 by a conventional mechanism, such as gear teeth, to transmit torque from piston 20 to power shaft 30. Note that in this embodiment, ring seal 26 and power shaft 30 rotate at different angular speeds, unlike in the embodiment of FIG. 1A, in which ring seal 26 and power shaft 30, being rigidly connected, rotate at the same angular speed.

In operation, in each power cycle of the engine of the present invention, a mixture of fuel, compressed air and steam is injected into combustion region 12, according to the protocol described below, and the expansion of the hot combustion gases push trailing surface 22 of piston 20, driving piston 20 around combustion housing 10, and thereby imparting torque to power shaft 30. Meanwhile, leading surface 24 of piston 20 pushes the partially spent gases of the previous power cycle out of exhaust region 14 through exhaust port 16.

Because the combustion gases leaving combustion chamber housing 10 through exhaust port 16 generally are still at a temperature and pressure significantly higher than ambient temperature and pressure, they are still capable of doing useful work. Therefore, preferred embodiments of the present invention provide at least one toroidal expansion chamber housing into which the combustion gases are transferred for further expansion in an expansion chamber contained within the expansion chamber housing. The construction of the expansion chamber housing is substantially identical to the construction of combustion chamber housing 10. The expansion chamber housing piston is operationally connected to power shaft 30 just as piston 20 of combustion chamber housing 10 is connected to power shaft 30, via a ring seal; and the interior of the expansion chamber housing serves as an expansion chamber, just as combustion region 12 and exhaust region 14 of combustion chamber 10 serve as a combustion chamber. The ring seal and the piston of the expansion chamber are provided with cooling and lubrication mechanisms similar to those provided for ring seal 26 and piston 20, including water channels, a labyrinth seal, and annular grooves around the periphery of the piston. Nevertheless there are two differences between the expansion chamber housing and combustion chamber housing 10. First, instead of injector 46, the expansion chamber housing is provided with an inlet port through which the combustion gases are introduced to the expansion chamber. Second, because the average pressure (force per unit area) of the combustion gases is lower in the expansion chamber than in the combustion chamber, to keep the forces on piston 20 and the expansion chamber housing piston balanced, the expansion chamber housing must have a correspondingly larger transverse cross section than combustion chamber housing 10. The number of expansion chamber housings is selected in accordance with the pressure of the combustion gases leaving the combustion chamber housing 10.

It will be obvious to one ordinarily skilled in the art that an engine based on the concept illustrated in FIGS. 1A, 1B and 1C may be run backwards, by imposing an external clockwise (as seen in FIG. 1A) torque on power shaft 30 (thus using power shaft 30 as a drive shaft) to compress gases in region 12 between trailing surface 22 of piston 20 and the transverse seal formed by vanes 44 of butterfly valve 42. Indeed, such a compressor would be structurally substantially identical to combustion chamber housing 10, including cooling and lubrication mechanisms similar to those employed in combustion chamber housing 10, except that exhaust port 16 would serve as a gas inlet port, and injector 46 would be replaced by an outlet valve that would open to release the compressed gas as piston 20 approaches the transverse seal. Just such a compressor is used in the most preferred embodiments of the engine of the present invention to provide compressed air for injection to combustion region 12 via injector 46, at the temperature and pressure required by the protocol described below: a temperature of between about 450° C. and about 600° C., and a pressure between about 10 kg/cm$^2$ and about 50 kg/cm$^2$. The optimum ratio of toroidal housing length to torus minor diameter for this application is between about 10:1 and about 50:1.

Figure 4:
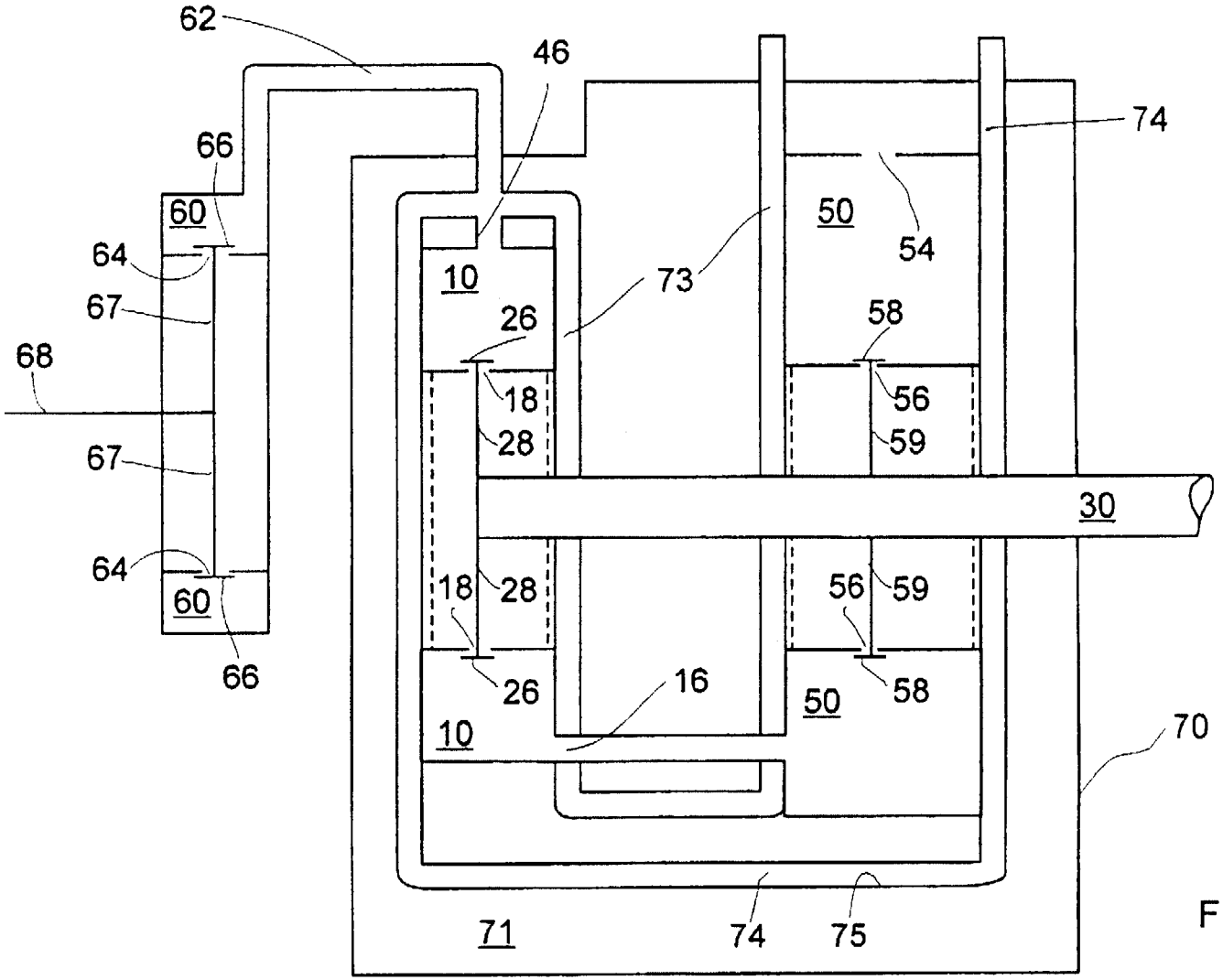
FIG. 4 is a schematic diagram of the housings of a most preferred embodiment of the engine, showing their interconnections.

FIG. 4 is a schematic diagram of the three toroidal housings (a compression chamber housing 60, combustion chamber housing 10, and an expansion chamber housing 50) of the most preferred embodiments of the engine of the present invention, showing their interconnections. Combustion chamber housing 10 features circumferential longitudinal slot 18, which is sealed by ring seal 26, as described above. Similarly, expansion chamber housing 50 features a circumferential longitudinal slot 56 that is sealed by an annular ring seal 58, and compression chamber housing 60 features a circumferential longitudinal slot 64 that is sealed by an annular ring seal 66. Just as ring seal 26 is rigidly connected to power shaft 30 by spokes 28, ring seal 58 also is rigidly connected to power shaft 30 by spokes 59; and ring seal 66 is rigidly connected to a drive shaft 68 by spokes 67. Air compressed in compression chamber housing 60 is introduced to combustion chamber housing 10 via an intake channel 62 and injector 46. Fuel is introduced to combustion chamber housing 10 via a fuel line 73. Steam is introduced to combustion chamber housing 10 via a water line 74. Combustion gases that leave combustion chamber housing 10 via exhaust port 16 are conducted to expansion chamber housing 50 by an exhaust channel 52. After further expansion and cooling, the combustion gases leave expansion chamber housing 50 via an exhaust port 54. Toroidal housings 10, 50 and 60 are drawn as rectangles in FIG. 4 to emphasize the fact that the cross sections of the toroids of the present invention need not be circular, but may be of any suitable shape.

Toroidal housings 10 and 50 are enclosed in a heat exchanger housing 70. Within the interior 71 of heat exchanger housing 70, the residual heat of the combustion gases leaving expansion housing 50 via exhaust port 54, and heat conducted through the walls of toroidal housings 10 and 50, are used to preheat fuel entering the combustion chamber of combustion chamber housing 10 via fuel line 73 and steam entering the combustion chamber of combustion chamber housing 10 via water line 74. The fuel and superheated water to be introduced to the combustion chamber of combustion chamber housing 10 are further heated by thermal contact with combustion chamber housing 10 and expansion chamber housing 50. This thermal contact is represented in FIG. 4 by showing fuel line 73 and water line 74 running alongside toroidal housings 10 and 50, in the manner of tubes 72 of FIG. 1B. For reference in the discussion to follow, the inner surface of water line 74 is designated by the reference numeral 75.

Figure 5A:
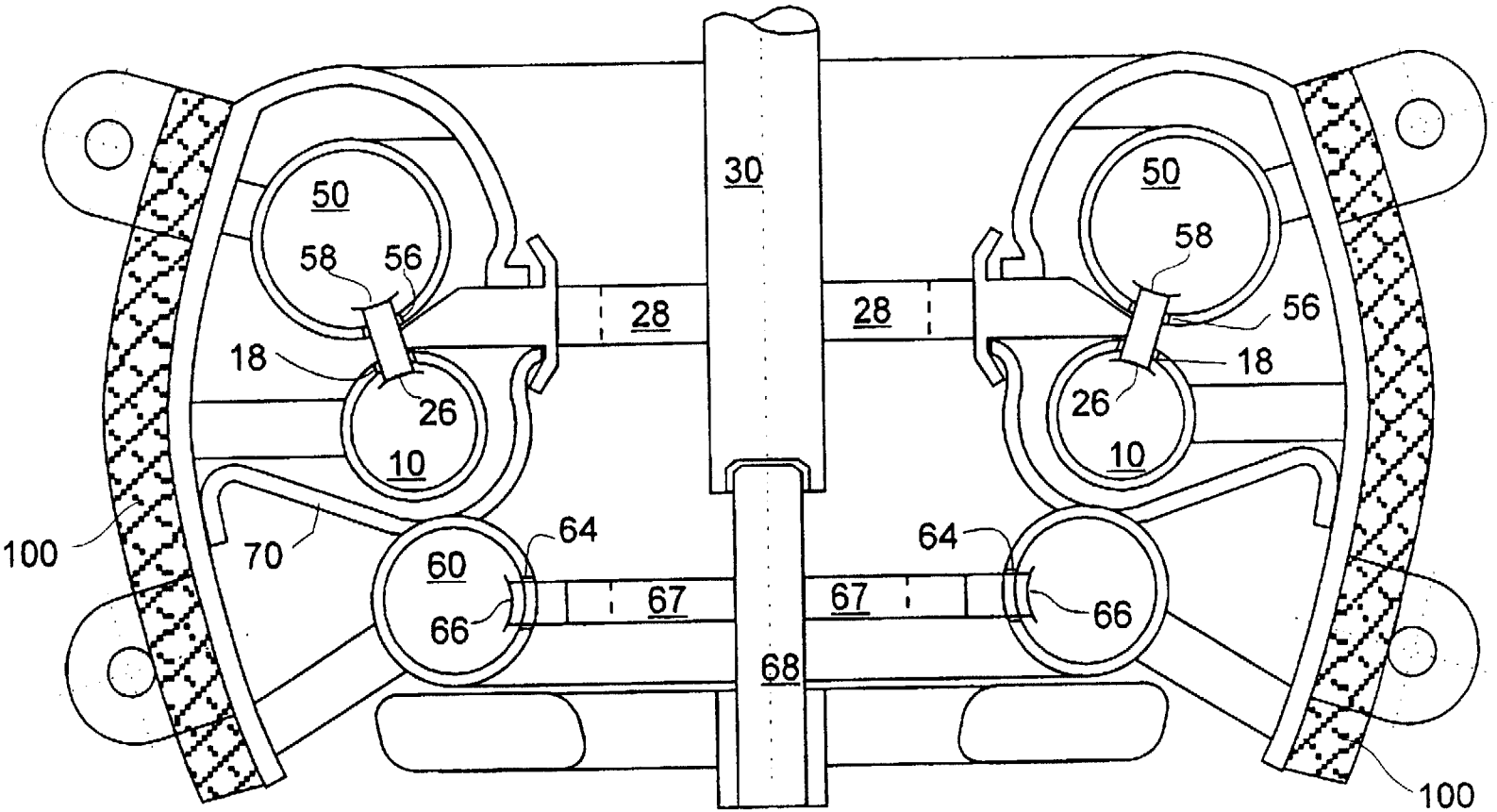
FIG. 5A is a partial cut-away perspective view, corresponding to FIG. 4, in which the three toroidal housings are mounted in tandem.
Figure 5B:
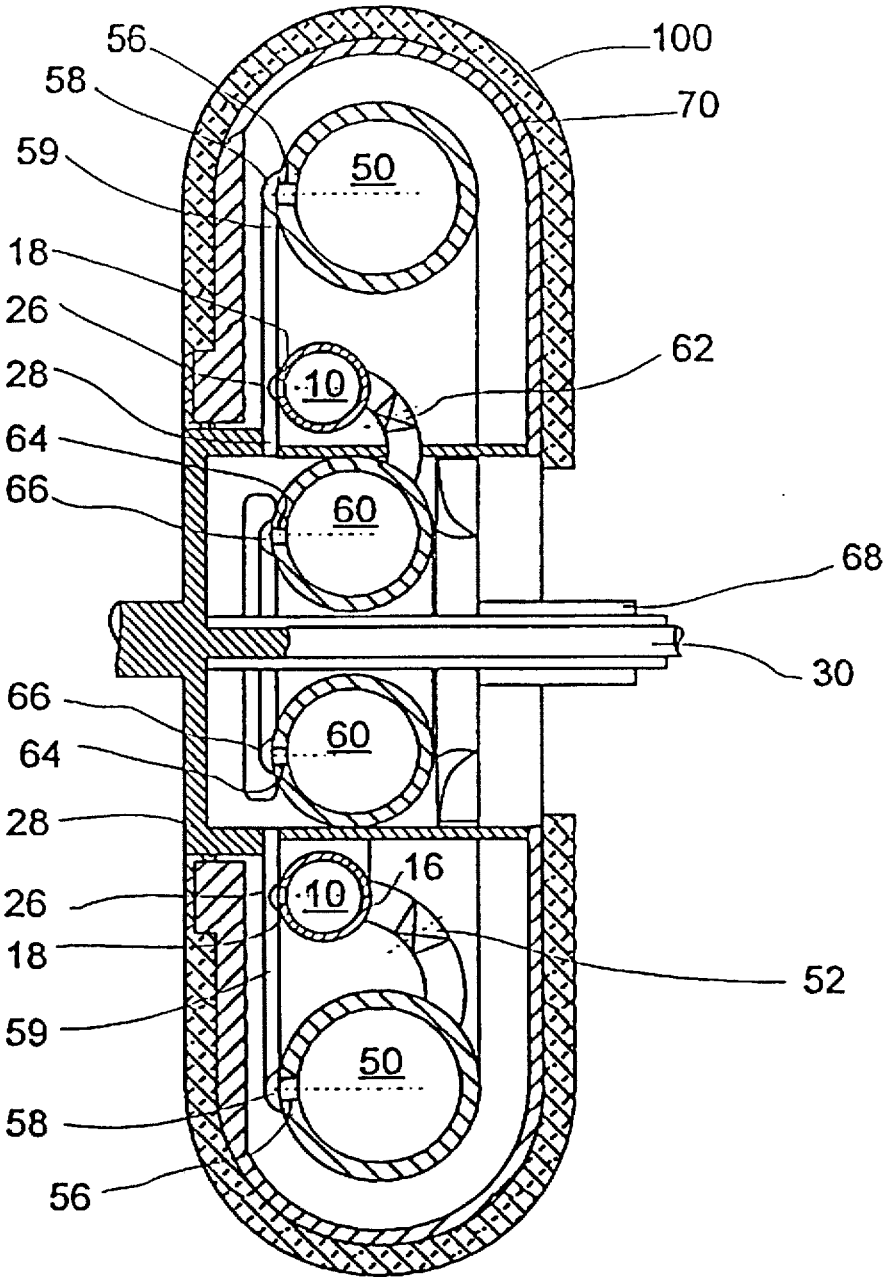
FIG. 5B is a partial cut-away perspective view, corresponding to FIG. 4, in which the three toroidal housings are nested.

FIGS. 5A and 5B are partial cut-away perspective views of preferred embodiments of the engine of the present invention, showing two different geometric arrangements of compression chamber housing 60, combustion chamber housing 10 and expansion chamber housing 50. In FIG. 5A, the toroidal housings are shown mounted in tandem. In FIG. 5B, the toroidal housings are shown nested in a single transverse plane. FIGS. 5A and 5B also show many of the other features shown in FIG. 4: slots 18, 56 and 64, ring seals 26, 58 and 66, power shaft 30, drive shaft 68, spokes 67 and heat exchanger housing 70. In the embodiment of FIG. 5A, ring seals 26 and 58 share spokes 28 as their rigid connection to power shaft 30. FIG. 5A also shows that slots 18 and 56 need not run along the innermost longitudinal circumferential line of their respective tori, but may run along any suitable longitudinal circumferential line. In addition, FIGS. 5A and 5B show the engine of the present invention encased in a layer 100 of a thermally insulating material, for further thermal efficiency.

Some of the surfaces of the engine of the present invention come into contact with hot water and steam during operation. These surfaces include, among others, inner surface 75 of water line 74 and inner surfaces 89 of distribution channels 88 in piston 20 and the corresponding inner surfaces of the distribution channels in the pistons of expansion chamber housing 50 and compression chamber housing 60, as well as peripheral surface 21 of piston 20 (including annular grooves 92 thereof), labyrinth seal 90 of ring seal 26, and the corresponding peripheral surfaces and annular grooves of the pistons of expansion chamber housing 50 and compression chamber housing 60, and the corresponding labyrinth seals of ring seals 58 and 66. To inhibit scale formation on these surfaces, these surfaces preferably are covered at least partially with a protective layer of a non-magnetic conductor such as copper.

Figure 6:
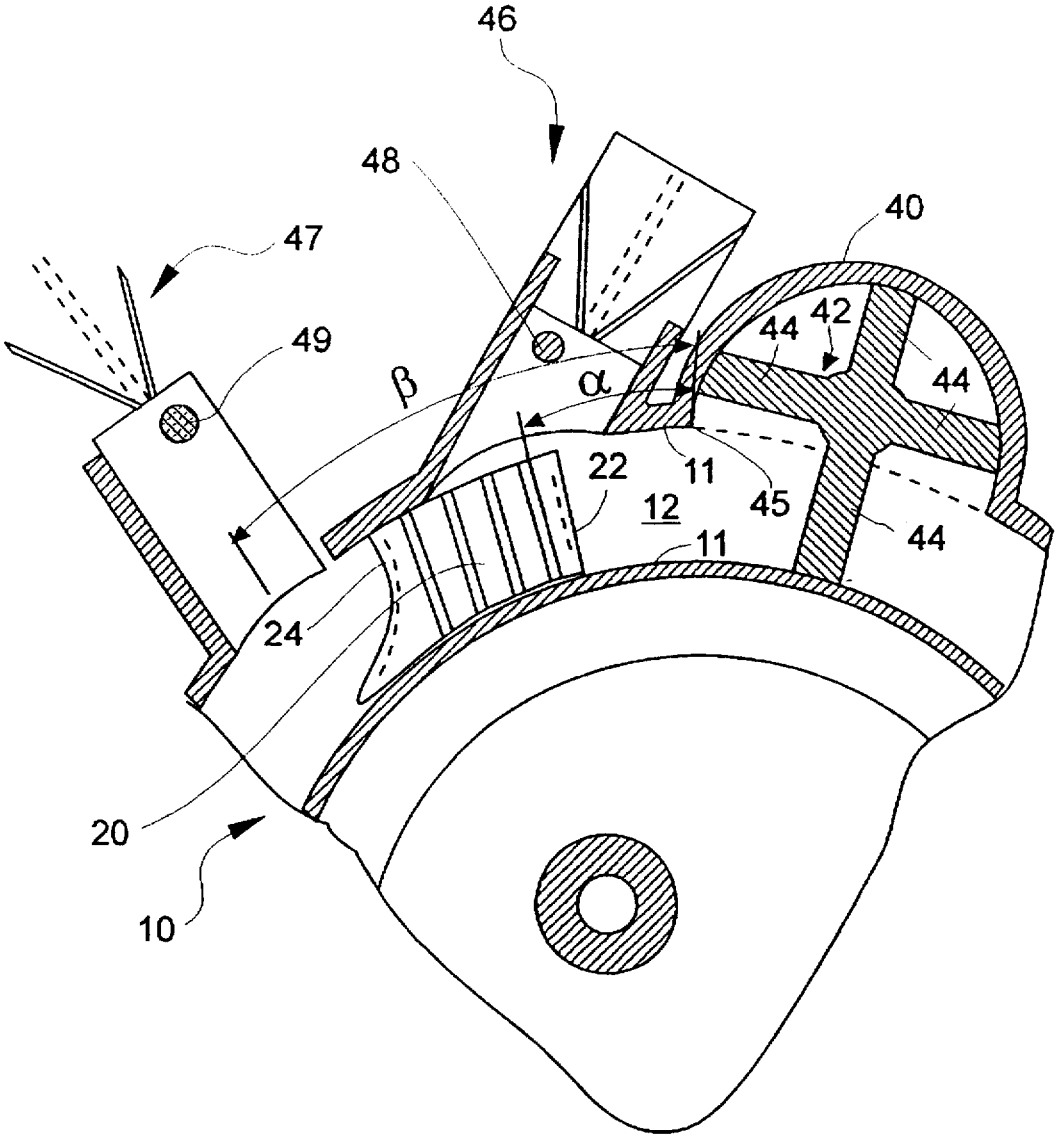
FIG. 6 is a partial longitudinal cross-section through an embodiment of a single-chamber toroidal combustion chamber housing that features two injectors.

FIG. 6 is a partial longitudinal cross section of combustion chamber housing 10 that is useful in explaining the preferred protocol for introducing air, fuel and steam into combustion region 12. The embodiment shown in FIG. 6 features two injectors, main injector 46 also shown in FIGS. 1A and 1C, and an auxiliary injector 47. Main injector 46 preferably is located at an angular separation $\alpha$ of between about 1° and about 2°, in the direction of travel of piston 20, from near end 45 of valve housing 40. Auxiliary injector 47 preferably is located at an angular separation $\beta$ of between about 30° and about 45° in the direction of travel of piston 20, from near end 45 of valve housing 40. Main injector 46 features an ignition device 48, for example a spark plug. Auxiliary injector 47 features a similar ignition device 49. The purpose of ignition devices 48 and 49 will be explained below.

The engine of the present invention is operated in two regimes, start-up and steady state, each with its own protocol for the introduction of air, fuel and steam to combustion region 12. The difference between the two protocols is that the start-up protocol does not use steam.

At start-up, with trailing surface 22 of piston 20 just past main injector 46, compressed air is injected through main injector 46 at a temperature of between about 450° C. and about 600° C. and at a pressure of between about 10 kg/cm$^2$ and about 50 kg/cm$^2$. Piston 20 continues to move further around the circular track defined by toroidal housing 10. When trailing surface 22 of piston 20 has passed auxiliary injector 47, the injection of air is terminated, and fuel is injected through injectors 46 and 47 at a pressure of between about 120 kg/cm$^2$ and about 400 kg/cm$^2$. If the flash point of the fuel is sufficiently low, the fuel self-ignites. If the flash point of the fuel is too high for self-ignition, then a supplementary charge of a gaseous fuel such as propane or butane is injected at a pressure of between about 15 kg/cm$^2$ and about 60 kg/cm$^2$, and ignition devices 48 and 49 are used to ignite the gas. The burning gas then ignites the fuel. As the fuel burns, the temperature within combustion region 12 rises to between about 1400° C. and about 1800° C., and the pressure increases to between about 40 kg/cm$^2$ and about 200 kg/cm$^2$. When trailing surface 22 of piston 20 is between about 60° and about 90° past valve housing 40, the injection of fuel from injectors 46 and 47 is terminated. This start-up protocol is continued until the conditions within heat exchanger housing 70 are such that the temperature of fuel to be injected via injectors 46 and 47 is between 80° C. and about 150° C. At this point, operation switches to the steady state protocol.

In steady state operation, air is injected into combustion region 12 using main injector 46, and both fuel and steam are injected into combustion region 12 using both main injector 46 and auxiliary injector 47. The only difference between the steady state protocol and the start-up protocol is that in the steady state protocol, steam is injected along with the fuel. The temperature of the injected steam is between about 120° C. and about 250° C. The pressure of the injected steam is between about 120 kg/cm$^2$ and about 400 kg/cm$^2$. The mixture of air, fuel and steam burns at a temperature of between about 1000° C. and about 1400° C.

In FIG. 6, only two injectors are drawn for simplicity. It is preferable to have separate injectors for start-up and for steady state operation, because the optimum injector nozzle sizes for injecting air and fuel differ between the two regimes. Thus, the preferred embodiment of combustion housing 10 actually has four injectors: a main start-up injector, and auxiliary start-up injector, a main steady state injector and an auxiliary steady state injector. The desired injection temperature of the injected steam is achieved in two stages. First, water is heated, by passing through heat exchanger housing 70, to a temperature of between about 80° C. and about 150° C. Then, the heated water is superheated, by thermal conduction from housings 10 and 50, as shown schematically in FIG. 4, to the desired range of between about 150° C. and about 250° C. Similarly, the fuel is heated to between about 80° C. and about 150° C. by passing through heat exchanger housing 70, and is further heated by thermal conduction from housings 10 and 50.

The ratio of air to fuel to steam in the combustion mixture of the present invention depends on the type of fuel and on the environmental conditions. For example, more steam must be injected in proportion to the fuel and the air when the ambient air is hot and dry than when the ambient air is cold and humid. The power delivered by the engine of the present invention is controlled by changing the total amount of fuel, air and steam injected into combustion region 12, not by changing their relative proportions. Typical proportions, by weight, are about 60% air, about 4% fuel, and about 36% steam, if the fuel is good-quality gasoline.

Figure 7:
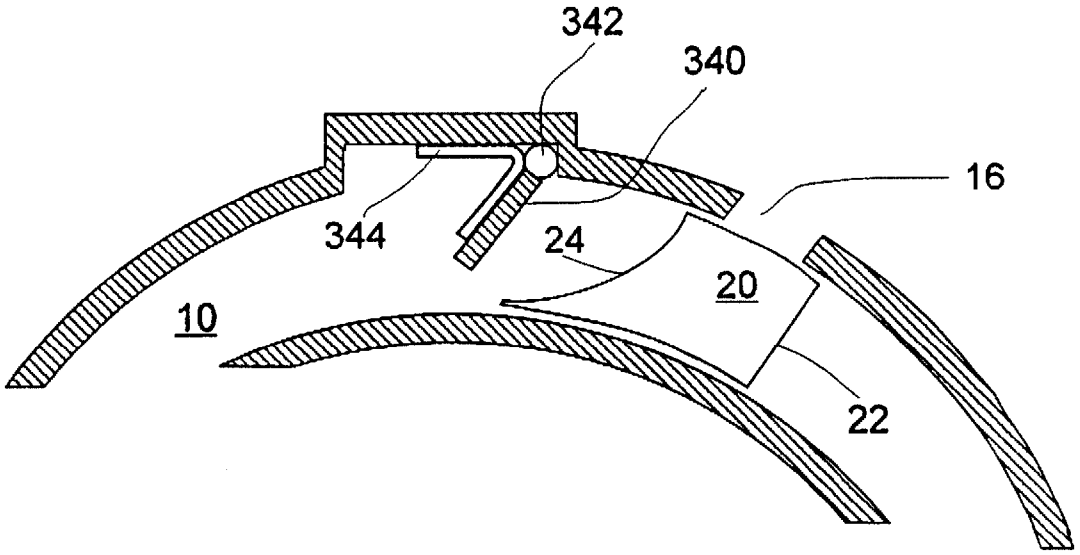
FIG. 7 is a partial longitudinal cross section through a variant of the toroidal combustion chamber housing of FIG. 1A, showing an alternative sealing mechanism based on a swing valve.

The engine of the present invention also includes various pumps, cams, and other control devices needed for its operation, for example, to rotate butterfly valve 42 and to inject fuel, air and steam to combustion region 12 according to the described protocols in the appropriate sequence and with the appropriate timing. These are not described herein because it will be clear to one ordinarily skilled in the art how to incorporate them in the engine of the present invention. An alternate mechanism for reversibly sealing combustion chamber housing 10, shown in FIG. 7, may be opened by the pressure of residual exhaust gas in exhaust region 14. The sealing mechanism in FIG. 7 is a swing valve 340 pivoting on a hinge 342. A restraining mechanism such as spring 344 is provided to keep swing valve 340 in a sealing position (vertical in FIG. 7) except while piston 20 passes the sealing mechanism. As piston 20 passes exhaust port 16, exhaust port 16 is closed, blocking the escape of any more gas left over from the previous cycle. Meanwhile, the combustion gases of the present cycle continue to push on trailing surface 22 of piston 20, and leading surface 24 of piston 20 pushes the residual gases against swing valve 340, causing swing valve 340 to open and let piston 20 pass.

Figure 8:
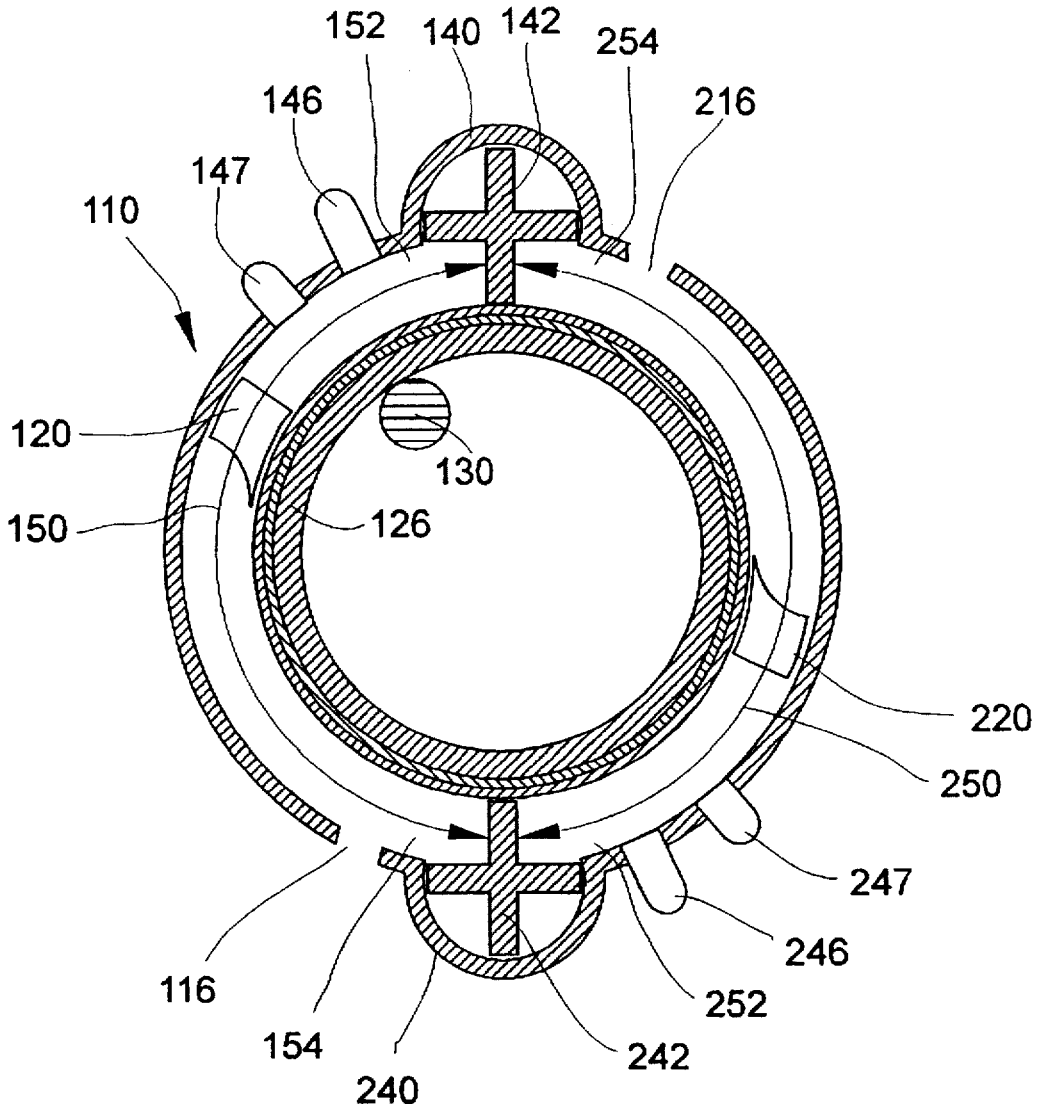
FIG. 8 is a longitudinal cross section through a toroidal combustion chamber housing having two combustion chambers.

The embodiments of the engine of the present invention described so far have one chamber and one piston per toroidal housing. For heavy duty applications, such as power plants, it is preferable to have several chambers and, correspondingly, several pistons per toroidal housing. FIG. 8 is a longitudinal cross section of a toroidal combustion housing 110 having two valve housings 140 and 240, on opposite sides of combustion housing 110, within which are mounted two butterfly valves 142 and 242. The geometric arrangement of valve housings 140 and 240 define two combustion chambers within combustion housing 110. A first combustion chamber 150 is bounded by an entrance end 152 at the left side of housing 140 and by an exit end 154 at the left side of housing 240. A second combustion chamber 250 is bounded by an entrance end 252 at the right side of housing 240 and by an exit end 254 at the right side of housing 140. There also are four injectors for air, fuel and steam; and two exhaust ports. Counterclockwise of housing 140 is a main injector 146 and an auxiliary injector 147. Counterclockwise of housing 240 is a main injector 246 and an auxiliary injector 247. Clockwise of housing 140 is an exhaust port 216. Clockwise of housing 240 is an exhaust port 116

Corresponding to the two combustion chambers, there are two pistons 120 and 220, on opposite sides of, and rigidly attached to, an annular ring seal 126. Ring seal 126 contacts and drives an eccentric power shaft 130. In multi-piston toroidal housings, this contact linkage to an eccentric power shaft is preferred over the rigid linkage to a central power shaft depicted in FIGS. 1A and 1B. As pistons 120 and 220 travel around combustion housing 110, they alternate combustion chambers. In each power cycle of an engine including combustion housing 110, air, fuel and steam are injected via injectors 146 and 147 and are burned in a combustion region defined by the seal created by valve 142 and the trailing surface of whichever piston is in chamber 150. The hot combustion gases push on that piston, and the leading surface of that piston pushes partially spent gases of the previous power cycle out through exhaust port 116. Meanwhile, air, fuel and steam are injected via injectors 246 and 247 and are burned in a combustion region defined by the seal created by valve 242 and the trailing surface of whichever piston is in chamber 250. The hot combustion gases push on that piston, and the leading surface of that piston pushes partially spent gases of the previous power cycle out through exhaust port 216.

The preferred internal dimensions of the combustion housing of the present invention depend on the number of combustion chambers in the combustion chamber housing. For single-chamber combustion chamber housings, such as combustion chamber housing 10, the preferred ratio of housing length to torus minor diameter is between about 5:1 and about 25:1. For multi-chamber combustion chamber housings, such as combustion chamber housing 110, the preferred ratio is between about 30:1 and about 75:1.

Accompanying combustion chamber housing 110 are one or more similarly constructed toroidal expansion chamber housings, also with two valve housings in each of which a butterfly valve is rotationally mounted, with two expansion chambers between the valve housings, with two pistons on opposite sides of an annular ring seal that drives power shaft 130, with two inlet ports, and with two exhaust ports. Exhaust gases from exhaust port 116 are conducted to one of the inlet ports of the first expansion chamber housing, and exhaust gases from exhaust port 216 are conducted to the other inlet port of the first expansion chamber housing. As the exhaust gases from combustion chamber housing 110 expand within the two expansion chambers of the expansion chamber housing, they push the two pistons of the expansion chamber housing around within the expansion chamber housing, thereby applying further torque to power shaft 130.

The positions of the injectors in multi-chamber combustion housings is the same as in a single-chamber combustion housing, scaled according to the number of combustion chambers. In a combustion chamber housing with N valve housings and N pistons, the regions between the valve housings constitute the combustion chambers, N in all. Each combustion chamber has its own main injector and its own auxiliary injector. The positions of the injectors within a combustion chamber may be defined, either in terms of angular separation from one end of the combustion chamber, or in terms of distance along the path traveled by the pistons through the combustion chamber. Each main injector is located at an angular separation of between about 1°/N and about 2°/N from the end of the combustion chamber through which the pistons enter, that is, between about 1/360 and 1/180 of the distance along the path through the combustion chamber. Similarly, each auxiliary injector is located at an angular separation of between about 30°/N and about 45°/N from the entrance end of the combustion chamber, that is, between about 1/12 and about 1/8 of the distance along the path through the combustion chamber. Thus, in combustion housing 110, injector 146 is located between about 1/360 and about 1/180 of the distance from entrance end 152 to exit end 154 through combustion chamber 150, and injector 147 is located between about 1/12 and about 1/8 of the distance from entrance end 152 to exit end 154 through combustion chamber 150. Similarly, injector 246 is located between about 1/360 and about 1/180 of the distance from entrance end 252 to exit end 254 through combustion chamber 250, and injector 247 is located between about 1/12 and about 1/8 of the distance from entrance end 252 to exit end 254 through combustion chamber 250.

The protocol for injecting air, fuel and steam into the combustion chambers of a multi-chamber housing is identical to the protocol for single-chamber combustion housings when defined in terms of the position of the trailing surfaces of the pistons relative to the injectors, and, for the termination of fuel and steam injection, in terms of the scaled positions of the trailing surfaces of the pistons relative to the entrance ends of the combustion chambers. Air injection is started when the trailing surface of a piston passes the main injector of a combustion chamber. When the trailing surface of the piston passes the auxiliary injector, the injection of air is terminated, and the injection of fuel (and steam, in the steady state regime) is begun. When the trailing surface of the piston reaches a point between about 1/6 and about 1/4 of the way through the combustion chamber, injection of fuel is terminated.

While the invention has been described with respect to a limited number of embodiments, it will be appreciated that many variations, modifications and other applications of the invention may be made.

What is claimed is:

1. An internal combustion engine for driving a power shaft having an axis of rotation, comprising:

(a) a substantially toroidal combustion chamber housing having an inner surface and a circumferential, longitudinal combustion housing slot;

(b) at least one combustion chamber housing piston, having a peripheral surface, slidably mounted within said combustion chamber housing;

(c) a substantially annular combustion chamber housing seal, rigidly attached to said at least one combustion chamber housing piston, slidably mounted within said combustion chamber housing slot so as to substantially fill said combustion chamber housing slot, and operationally connected to the power shaft so as to transmit force from said at least one combustion chamber housing piston to the power shaft;

(d) a plurality of ring seal cooling channels within said combustion chamber housing ring seal;

(e) a plurality of piston cooling channels within said at least one combustion chamber housing piston; and (f) a labyrinth seal between said combustion chamber housing ring seal and said inner surface of said combustion chamber housing.

2. The engine of claim 1, wherein said peripheral surface of said at least one combustion chamber housing piston features at least one annular groove, and wherein said peripheral surface of said at least one combustion chamber housing piston is at least partially lined with a nonmagnetic conductor.

3. The engine of claim 2, wherein said nonmagnetic conductor is copper.

4. The engine of claim 1, wherein said piston cooling channels and said labyrinth seal are at least partially lined with a nonmagnetic conductor.

5. The engine of claim 4, wherein said nonmagnetic conductor is copper.

6. The engine of claim 1, wherein said combustion chamber housing is substantially concentric with the axis of rotation.

7. The engine of claim 6, wherein said operational connection of said combustion chamber housing ring seal to the drive shaft is a rigid attachment.

8. The engine of claim 1, further comprising:

(d) at least one combustion chamber housing sealing mechanism for alternately:

(i) forming a transverse seal within said combustion chamber housing; and (ii) removing said transverse seal.

9. The engine of claim 8, wherein each of said at least one combustion chamber housing sealing mechanism includes:

(i) a valve housing opening on said combustion chamber housing; and (ii) a butterfly valve rotatably mounted within said valve housing.

10. The engine of claim 8, wherein each of said at least one combustion chamber housing sealing mechanism includes a swing valve.

11. The engine of claim 1, further comprising:

(d) a substantially toroidal expansion chamber housing having a circumferential, longitudinal expansion chamber housing slot;

(e) at lease one expansion chamber housing piston, having a peripheral surface, slidably mounted within said expansion chamber housing;

(f) a substantially annular expansion chamber housing ring seal, rigidly attached to said at least one expansion chamber housing piston, slidably mounted within said expansion chamber housing slot so as to substantially fill said expansion chamber housing slot, and operationally connected to the power shaft so as to transmit force from said at least one expansion chamber housing piston to the power shaft; and (g) an exhaust channel connecting said combustion chamber housing with said expansion chamber housing.

12. The engine of claim 11, wherein said peripheral surface of said at least one expansion chamber housing piston features at least one annular groove, and wherein said peripheral surface of said at least one expansion chamber housing piston is at least partially lined with a nonmagnetic conductor.

13. The engine of claim 12, wherein said nonmagnetic conductor is copper.

14. The engine of claim 11, further comprising:

(h) a plurality of ring seal cooling channels within said expansion chamber housing ring seal;

(i) a plurality of piston cooling channels within said at least one expansion chamber housing piston; and (j) a labyrinth seal between said expansion chamber housing ring seal and said inner surface of said expansion chamber housing.

15. The engine of claim 14, wherein said piston cooling channels and said labyrinth seal are at least partially lined with a nonmagnetic conductor.

16. The engine of claim 15, wherein said nonmagnetic conductor is copper.

17. The engine of claim 11, wherein said expansion chamber housing is substantially concentric with the axis of rotation.

18. The engine of claim 17, wherein said operational connection of said expansion chamber housing ring seal to the drive shaft is a rigid attachment.

19. The engine of claim 11, further comprising:

(h) at least one expansion chamber housing sealing mechanism for alternately:

(i) forming a transverse seal within said expansion chamber housing; and (ii) removing said transverse seal.

20. The engine of claim 19, wherein said at least one expansion chamber housing sealing mechanism includes:

(i) a valve housing opening on said expansion chamber housing; and (ii) a butterfly valve rotatably mounted within said valve housing.

21. The engine of claim 19, wherein said at least one expansion chamber housing sealing mechanism includes a swing valve.

22. The engine of claim 11, further comprising:

(h) a heat exchanger housing, having an interior, and substantially surrounding at least part of said combustion chamber housing and at least part of said expansion chamber housing; and (i) an exhaust port opening from said expansion chamber housing to said interior of said heat exchanger housing.

23. The engine of claim 1, further comprising:

(d) a water line, having an inner surface, in thermal contact with said combustion chamber housing.

24. The engine of claim 23, wherein said inner surface of said water line is at least partially lined with a nonmagnetic conductor.

25. The engine of claim 24, wherein said nonmagnetic conductor is copper.

26. The engine of claim 1, further comprising:

(d) a fuel line in thermal contact with said combustion chamber housing.

27. The engine of claim 1, further comprising:

(d) an air compressor; and (e) an intake channel connecting said air compressor to said combustion chamber housing.

28. The engine of claim 27, wherein said air compressor includes:

(i) a drive shaft having an axis of rotation;

(ii) a substantially toroidal compression chamber housing having a circumferential, longitudinal compression chamber housing slot;

(iii) a compression chamber housing piston, having a peripheral surface, slidably mounted within said compression chamber housing; and (iv) a substantially annular compression chamber housing ring seal, rigidly attached to said compression chamber housing piston, slidably mounted within said compression chamber housing slot so as to substantially fill said compression chamber housing slot, and operationally connected to said drive shaft so as to transmit force from said drive shaft to said compression chamber housing piston.

29. The engine of claim 28, wherein said peripheral surface of said compression chamber housing piston features at least one annular groove, and wherein said peripheral surface of said compression chamber housing piston is at least partially lined with a nonmagnetic conductor.

30. The engine of claim 29, wherein said nonmagnetic conductor is copper.

31. The engine of claim 28, further comprising:

(v) a plurality of ring seal cooling channels within said compression chamber housing ring seal;

(vi) a plurality of piston cooling channels within said compression chamber housing piston; and (vii) a labyrinth seal between said compression chamber housing ring seal and said inner surface of said compression chamber housing.

32. The engine of claim 31, wherein said piston cooling channels and said labyrinth seal are at least partially lined with a nonmagnetic conductor.

33. The engine of claim 32, wherein said nonmagnetic conductor is copper.

34. The engine of claim 28, wherein said air compressor further includes:

(v) a compression chamber housing sealing mechanism for alternately:

(A) forming a transverse seal within said compression chamber housing; and (B) removing said transverse seal.

35. The engine of claim 34, wherein said compression chamber housing sealing mechanism includes:

(A) a valve housing opening on said compression chamber housing; and (B) a butterfly valve rotatably mounted within said valve housing.

* * * * *